US005138741A

United States Patent [19]

Allen

[11] Patent Number: 5,138,741

[45] Date of Patent: Aug. 18, 1992

[54] REMOTE CONTROLLED SLUDGE REMOVAL SYSTEM

[76] Inventor: Henry W. Allen, 12014 Lake Lery, Baton Rouge, La. 70816

[21] Appl. No.: 504,418

[22] Filed: Jun. 13, 1990

[51] Int. Cl.[5] ..... B08B 9/08

[52] U.S. Cl. ..... 15/340.1; 15/1.7; 15/3; 15/93.1

[58] Field of Search ..... 15/1.7, 3, 49.1, 50.1, 15/93.1, 340.1, 340.3, 340.4, 246.5; 134/8

[56] References Cited

U.S. PATENT DOCUMENTS 4,162,680 7/1979 Coch ..... 134/186 X
4,223,622 9/1980 Mazzucato ..... 15/338
4,407,035 10/1983 Lindqvist ..... 15/93.1
4,407,678 10/1983 Furness et al. ..... 134/167 R
4,469,143 9/1984 Vazin ..... 134/166 X
4,685,974 8/1987 Furness et al. ..... 134/181 X
4,770,711 9/1988 Deal, III et al. ..... 134/168 R
4,777,971 10/1988 Tribout et al. ..... 15/1.7
5,001,800 3/1991 Parenti et al. ..... 15/1.7

*Primary Examiner*—Edward L. Roberts
*Attorney, Agent, or Firm*—David L. Ray

[57] ABSTRACT

A movable oil and oil sludge removing apparatus which can be inserted into the manhole of a crude oil storage, the apparatus including a platform, a pump connected to the platform, two drive assemblies connected to the platform, tracks connected to each drive assembly to drive the drive assemblies, a motor for driving the drive assemblies, and an auger apparatus connected to the platform for cutting the sludge and channeling the sludge to the pump intake.

4 Claims, 3 Drawing Sheets

REMOTE CONTROLLED SLUDGE REMOVAL SYSTEM

BACKGROUND OF THE INVENTION

1. Field of the Invention

The present invention is related to devices for removing oil sludge that accumulates in crude oil storage tanks.

2. Description of the Related Art

The accumulation of sludge in crude oil storage tanks is a problem faced by many oil companies around the world that store crude oil before it is refined. Oil storage tanks must be cleaned periodically by manned crews usually shoveling out the sludge which accumulates on the bottom of the tank.

Cleaning oil storage tanks is presently an arduous and hazardous task. As many as 15 or 20 people may be placed inside a tank to clean the sludge from the tank by hand and prepare the tank with hand tools for inspection or repair.

The following patents disclose art related to the present invention:

U.S. Pat. No. 4,770,711 discloses a method for cleaning chemical sludge deposits of oil storage tanks with a fluidizing agent, the tank having a floor, a side wall and a passageway through the side wall positioned adjacent the floor of the tank comprises a frame having a central portion and first and second end portions. The frame is configured and dimensioned to pass through the passageway. A pair of independently movable endless chain belts are position on opposite sides of the frame for selectively moving the frame within the oil storage tank to selected locations. A hydraulic line coupled to the central portion of the frame discharges the fluidizing agent onto an adjacent first portion of the sludge deposit so as to form a pool of sludge and fluidizing agent. A suction pump is positioned on the central portion of the frame for drawing up the poll of sludge and fluidizing agent. A suction pump is positioned on the central portion of the frame for drawing up the pool of sludge and fluidizing agent. A plurality of nozzles disposed adjacent the first end portion of the frame are in fluid communication with the suction pump so as to provide pressurized agitation and discharging of the pool of sludge and fluidizing agent onto a second portion of the sludge deposit adjacent said first end portion of the frame so as to dislodge and also aid in liquefying the second portion of the sludge deposit. The chain belts and suction pump are driven preferably by a pair of separately operable hydraulic motors supported on the frame.

U.S. Pat. No. 4,685,974 discloses a method for clearing settled sludge from the bottom of a storage tank uses a machine including a central body rotatable about which is a casing provided with two substantially diametric nozzles arranged so that liquid emerging therefrom sweeps substantially only in one plane, a turbine rotating the casing about the central body and half cylinder ensuring that when the casing is continuously rotated, alternately ne nozzle is closed for substantially 180° rotation while the other nozzle is open. Such machines may be suspended above the floor of the tank adjacent to a wall thereof. Liquid is emitted from the nozzles in a sweep substantially parallel to the bottom plane of the storage tank, thereby re-suspending the sludge which thereafter is withdrawn as a suspension.

U.S. Pat. No. 4,469,143 discloses a tank truck purging system to permit access for repair, or maintenance without environmental pollution or hazard to workmen entering the tank. In accordance with the invention an elongated cylindrical storage tank is tilted about its horizontal axis, to form a reservoir for purge water. The tank is connectable as by flexible hoses to fill and drain connections for a tank compartment of a truck, rail car, or other bulk liquid vehicle. Purge water is pumped from the storage tank at a level above the lower tilted end of the elongated tank and vapor displaced from the tank compartment by the water is recovered through a vapor recovery system. Desirably, the compartment is filed until it overflows into the vapor recovery line. Water is returned to the storage tank at a position near the upwardly tilted end. The tilted arrangement permits gravity separation and accumulation of minor amounts of light hydrocarbons, such as diesel fuel or gasoline at an upper separation zone formed by the upwardly tilted end. A similar separation zone or volume for accumulation of rust particles, sludge and the like is formed at the lower tilted end. Hydrocarbons lighter than water are flushed from the tilted upper end of the reservoir tank by adding water to the reservoir tank so that it overflows through a line connected to a separator tank. Heavy particles from the lower tilted end are removed through a cleanout line entering near the lower tilted end are removed through a cleanout line entering near the lower tilted end of the reservoir tank. Water may also be removed from the tank to lower the water level at the upper tilted end to increase the surface area of the separation zone for accumulation of such lighter hydrocarbons.

U.S. Pat. No. 4,407,678 discloses a sludge removal machine suitable for removing sludge from the bottom of a storage tank which comprises a central body rotatable about which is a casing provided with two substantially diametric nozzles arranged so that liquid emerging therefrom sweeps substantially only in one plane, a turbine rotation the casing about the central body and means ensuring that when the casing is continuously rotated, alternately one nozzle is closed for substantially 180° rotation while the other nozzle is open. Such machines may be suspended above the floor of the tank adjacent to a wall thereof.

U.S. Pat. No. 4,223,622 discloses a tanker desludging system in a marine vessel adapted to carry liquids such as crude oil which embodies a certain amount of solid residue, apparatus is provided for removing the latter from the vessel's storage tanks. The liquid crude is normally removed by a manifolded discharge conduits, each conduit being fixedly positioned with its inlet port spaced above the floor of the tank to withdraw liquid from the tank. A portable cleaning apparatus is provided to remove accumulated sludge and the like from the tank floor, which cleaning apparatus is adapted to removable engage a discharge conduit whereby to ingest sludge from the latter.

U.S. Pat. No. 4,162,680 discloses a non-polluting system for metal surface treatments of metals, e.g., in coating base metal parts with an adherent coating of zinc, cadmium or similar protective metal by means of wet impact plating or electroplating, or in chroming or phosphating metal surfaces. A preferred embodiment relates to a wet impact plating process wherein the several solutions used in preparing the work, in plating it an in rinsing it are individually segregated after use and re-used in consecutive plating cycles so that release of ecologically objectionable effluent is eliminated and chemical and metal components fed into the process are conserved instead of being discarded after each plating cycle.

U.S. Pat. No. 4,147,269 discloses a fuel oil storage tank which is a cylindrical vessel of large size and integral molded construction is provided having a depressed well which accumulates sludge formed in the course of storage of hydrocarbon fuels. A hole positioned in the top of the vessel directly above said well permits insertion of a pipe which, by suction means, positioned below the tank and adjacent each end, causes the entire vessel to be tilted downwardly toward the well, thereby causing gravimetric migration of sludge toward the well.

SUMMARY OF THE INVENTION

In accordance with the present invention there is provided a movable sludge removing apparatus which can be inserted into the manhole of a crude oil storage tank, the apparatus including a platform, a pump connected to the platform, two drive assemblies connected to the platform, tracks connected to each drive assembly to drive the drive assemblies pontoon, a motor for driving the drive assemblies, and an auger apparatus connected to the platform for cutting the sludge and channeling the sludge to the pump intake.

BRIEF DESCRIPTION OF THE DRAWINGS

The invention will be more easily understood by reference to the drawings in which.

DESCRIPTION OF THE PREFERRED EMBODIMENTS

Figure 1:
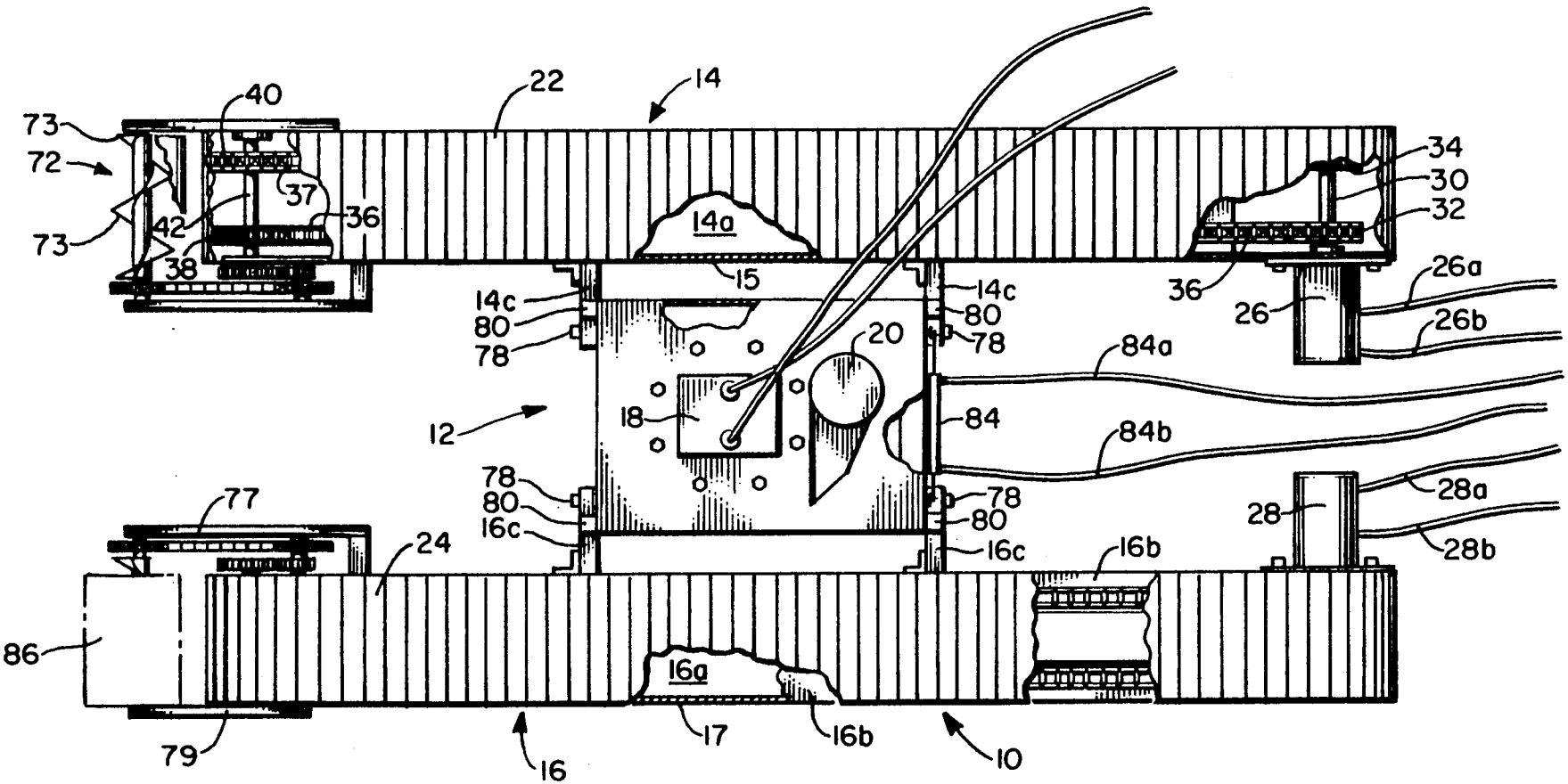
FIG. 1 is a schematic, partly cut-away top view of the sludge removal apparatus of the invention.

Referring now to the drawings, the sludge removal apparatus of the invention can be seen to be generally indicated by the numeral 10. By sludge is meant the viscous residue of hydrocarbons such as crude oil, or other sediment such as sewerage digester sediment, or sludge contained in sludge pits.

The sludge removal apparatus 10 includes a platform generally indicated by the numeral 12 which is connected to two pontoons generally indicated by the numerals 14 and 16 having drive assembly walls 15 and 17, respectively. Drive assembly 14 has bottom 14*a* and drive assembly 16 has bottom 16*a* and top 16*b* shown in FIG. 1. Mounted on platform 12 is a pump 18 having a conventional intake (not shown) to receive sludge propelled by the auger cutters such as 72 and a discharge 20 connected thereto. A hose may be connected to discharge 20 to convey sludge from the inside of the tank being cleaned to holding tanks or the like on the outside.

Pump 18 is preferably a submersible pump designed to pump viscous liquids such as crude oil sludge. Pump 18 can be controlled remotely from the tank or other location from which sludge is being removed. Preferably, pump 18 is capable of pumping sludge containing up to twenty-five percent solids.

Connected to each of drive assemblies 14 and 16 are tracks 22 and 24, respectively. Tracks 22 and 24 can be made of steel coated with rubber or any other suitable material that will suit the chemical climate encountered in the tank which is being cleaned by the sledge removal apparatus 10 and prevent sparks. Electromagnets could be used if needed in the steel portion of the track to increase traction.

Tracks 22 and 24 are driven at their rear ends by hydraulic motors 26 and 28, respectively. Motors 26 and 28 are preferably hydraulic motors which may be operated while submerge in oil or water. Motor 26 is supplied with hydraulic fluid through hydraulic fluid lines 26*a* and 26*b*, and motor 28 is supplied with hydraulic fluid through hydraulic fluid lines 28*a* and 28*b* which extend to the outside of the tank being cleaned when the sludge removal apparatus 10 is placed in a tank to be cleaned. Hydraulic fluid flow through hydraulic fluid lines 26*a*, 26*b*, 28*a* and 28*b* can be connected to valves outside of the tank being cleaned and operated manually or by computers, microprocessors, or other programmable systems.

In FIG. 1, hydraulic motor 26 can be seen to have axle 30 connected thereto and driven thereby. Axle 30 has sprockets 32 and 34 rigidly connected thereto. Preferably, sprockets 32 and 34 and all other sprockets are constructed of a material that will not produce sparks such as nylon. Sprocket 32 engages roller chain 36 connected inside track 22 to drive track 22 as is known in the art. Sprocket 34 engages a similar roller chain 37 shown on the front of track 22 in FIG. 1. Motor 28 and track 24 have sprockets and roller chain inside track 24 which are identical to sprockets 32 and 34 and roller chains 36 and 37 but are not shown in the drawings for brevity.

Two additional sprockets 38 and 40 are located in the front of track 22 rigidly connected to axle 42 as shown in FIG. 1. Sprockets 38 and 40 are driven by roller chains 36 and 37, respectively, and drive axle 42.

Figure 3:
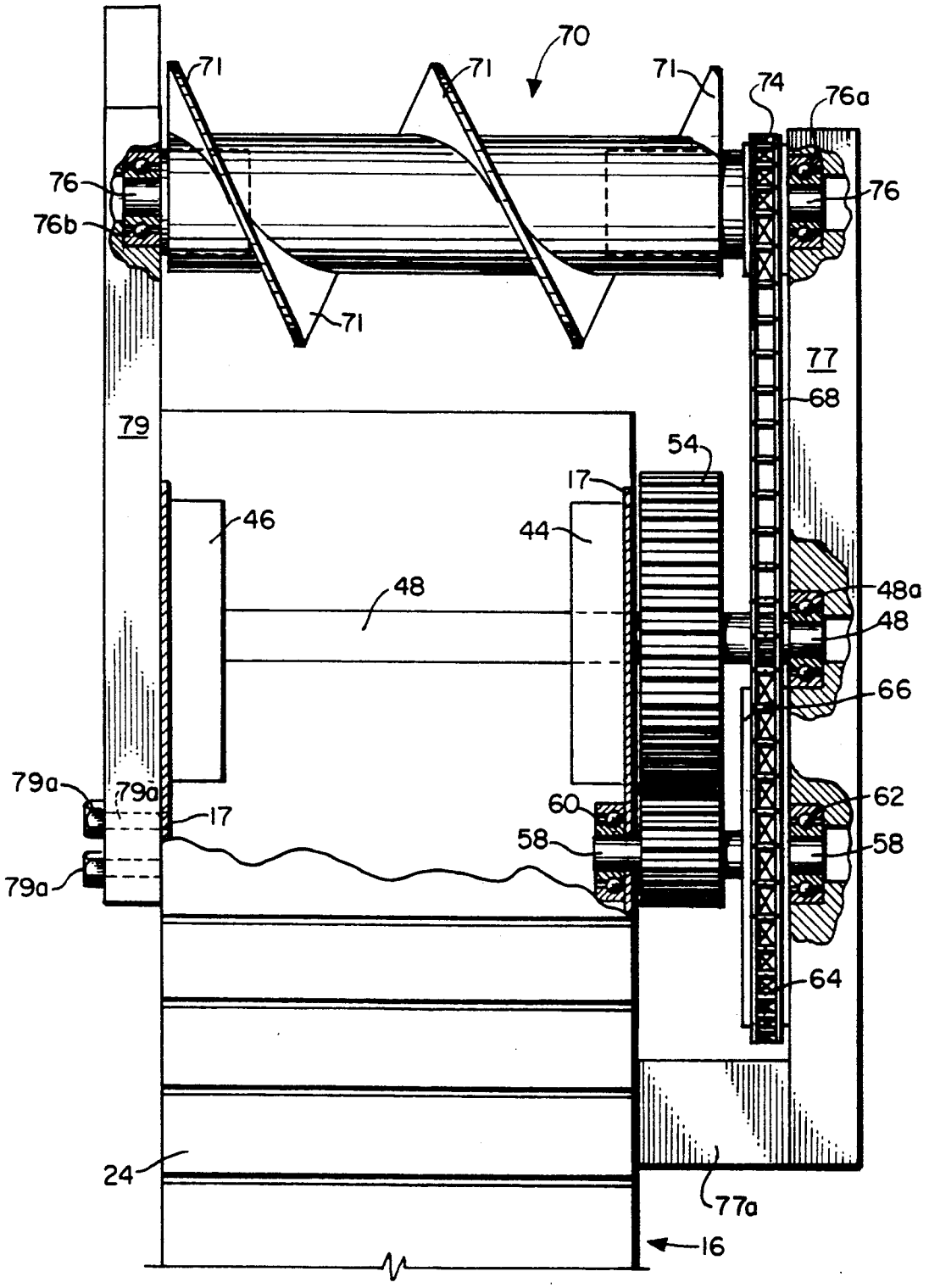
FIG. 3 is a schematic, partly cut-away top view of the auger assembly of the invention.

Two sprockets 44 and 46 are shown in FIG. 3 to be located in the front of track 24 rigidly connected to axle 48 which is rotatably connected to walls 17—17. Sprockets 44 and 46 are identical to sprockets 38 and 40 shown in FIG. 1 and are driven by roller chains(not shown) inside track 24.

Sprockets 44 and 46 drive axle 48 which is rigidly connected to gear 54 shown in FIG. 3. Gear 54 engages and drives gear 56 rigidly connected to axle 58 rotatably mounted in ball bearings 60 and 62.

Rigidly connected to axle 58 adjacent to gear 56 is sprocket 64 which has teeth 66 that engage drive chain 68 which drives the auger cutter generally indicated by the numeral 70. Drive chain 68 engages sprocket 74 rigidly connected to axle 76 to cause axle 76 to rotate. Auger cutter 70 is rigidly connected to axle 76 and rotates therewith causing blades 71 of auger cutter 70 to dig up sludge located in the bottom of a storage tank.

A chain cover 77 connected to the wall of drive assembly 16 by chain cover support 77*a* holds axles 76 and 58 in bearings 62 and 76*a*, and is secured to axle 48 by bearing 48*a*. The end of axle 76 opposite from chain cover 77 is supported by bearing 76*b* which is held in auger cutter support 79 which is connected to the vertical wall 17 of drive assembly 16 by bolts 79*a*.

An auger cutter generally indicated by the numeral 72 and having blade 72*a* is located on the front of track 22 and is identical to auger cutter 70. The rotating auger cutters 70 and 72 cut the sludge and force the sludge to one side, preferably to the area between the drive assemblies for intake by pump 18 and discharge to the outside of the tank.

Figure 2:
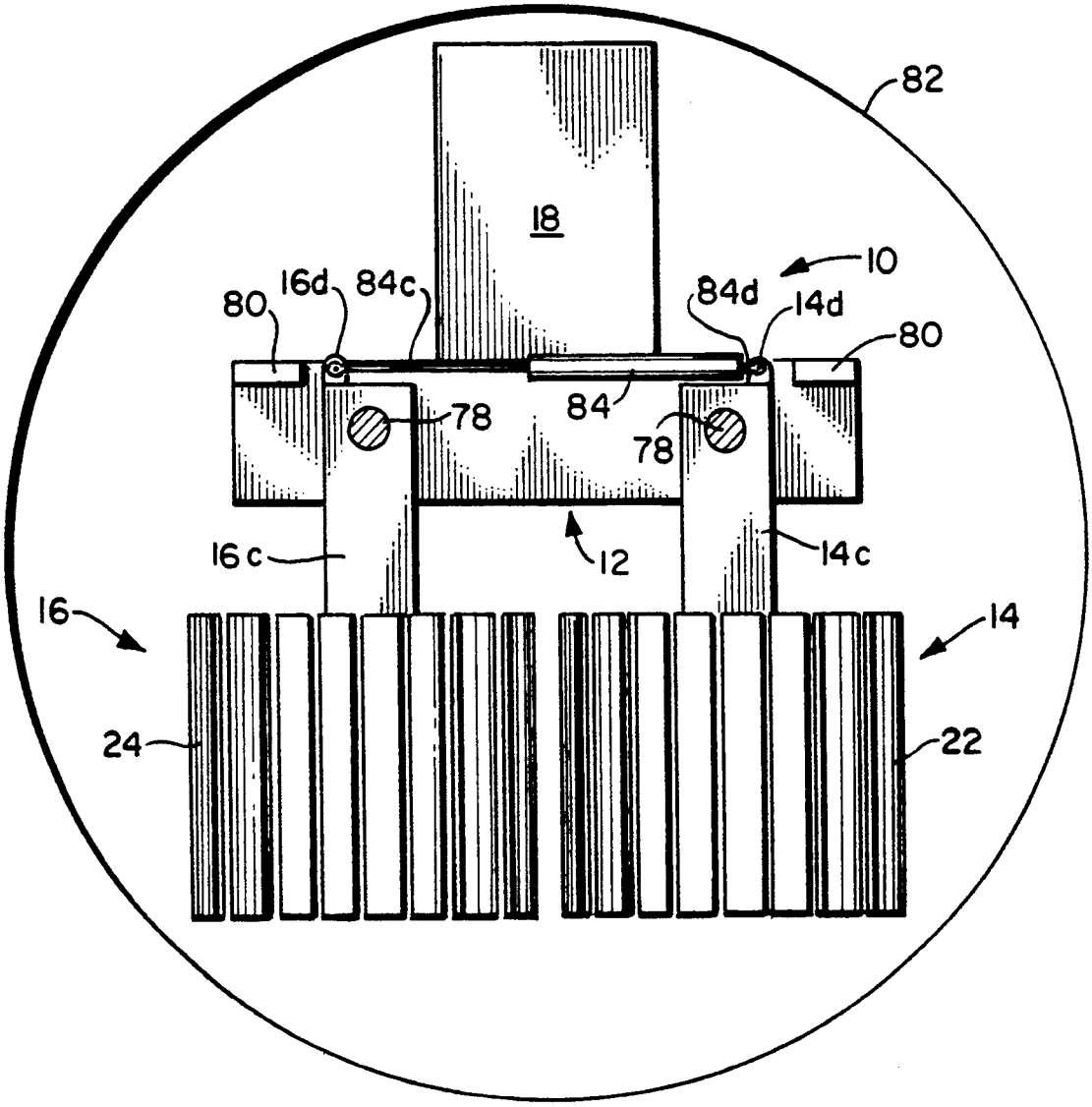
FIG. 2 is a schematic rear end view of the sludge removal apparatus of the invention folded for insertion into the manhole of a storage tank.

As can be seen in FIGS. 1 and 2, drive assembly 14 has two drive assembly support members 14*c*—14*c* and drive assembly 16 has two drive assembly support members 16*c*—16*c* which can be rotated about pins 78—78 in platform 12. Stops 80—80 are rigidly connected to platform 12 to maintain drive assemblies 14 and 16 in the working position shown in FIG. 1 after insertion of sludge removal apparatus 10 into a manhole 82 as shown in FIG. 2 which may be in the top or side of a tank having sludge therein.

A hydraulic ram 84 shown in FIGS. 1 and 2 can be used to pivot drive assemblies 14 and 16 about pins 78—78. Hydraulic ram 84 has hydraulic fluid supply lines 84*a* and 84*b* connected thereto. One end 84*c* of hydraulic ram 84 can be seen in FIG. 2 to be connected to member 16*d* of support member 16*c* and the other end 84*d* of hydraulic ram 84 can be seen to be connected to member 14*d* of support member 14*c*. Thus, when hydraulic ram 84 elongates to the position shown in FIG. 1, drive assemblies 14 and 16 assume the position shown in FIG. 2.

An auger cutter cover 86 may be placed over the auger cutters 70 and 72 if desired to prevent sludge from being thrown upwardly. The auger cutters 70 and 72 allow a wider removal area than the pump 18 alone can give.

The sludge removing apparatus 10 may be equipped with pipe spray nozzles or the like to apply solvents or similar substances to the auger cutters 70 and 72 for softening materials, and/or to the tank sidewalls and bottom. Furthermore, the sludge removal apparatus 10 of the invention may be operated completely submerged beneath oil or water.

Although the preferred embodiments of the present invention have been disclosed and described in detail above, it should be understood that the invention is in no sense limited thereby, and its scope is to be determined by that of the following claims:

What is claimed is:

1. A movable sludge pumping apparatus which can be inserted into the inside of a storage tank containing sludge through a conventional manhole in the storage tank, said movable sludge pumping apparatus comprising:

a. a platform, b. pump means rigidly connected to said platform for pumping sludge from said storage tank, c. drive assembly means pivotally connected to said platform means for supporting and moving said platform means and said pump means around the inside of said storage tank to pump said sludge from selected areas of said storage tank, said drive assembly means being foldable beneath said platform means to enable said sludge apparatus to be insertable into the manhole of said storage tank, and d. rotatable cutter means rotatably connected to said drive assembly means for cutting and channeling said sludge to said pump.

2. The apparatus of claim 1 wherein track means are connected to said drive assembly means to propel said sludge pumping apparatus around the inside of said storage tank.

3. The apparatus of claim 2 wherein motor means is connected to said drive assembly means for driving said track means.

4. The apparatus of claim 1 wherein said cutter means comprises auger means.

* * * * *